US007094105B2

(12) United States Patent
Kobayashi

(10) Patent No.: US 7,094,105 B2
(45) Date of Patent: Aug. 22, 2006

(54) FUSE-RECEIVING STRUCTURE AND ELECTRICAL JUNCTION BOX USING FUSE-RECEIVING STRUCTURE

(75) Inventor: Nobuchika Kobayashi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 11/144,612

(22) Filed: Jun. 6, 2005

(65) Prior Publication Data

US 2005/0272314 A1 Dec. 8, 2005

(30) Foreign Application Priority Data

Jun. 8, 2004 (JP) ..... 2004-170314

(51) Int. Cl.
*H01R 13/68* (2006.01)
*H01R 33/95* (2006.01)

(52) U.S. Cl. ..... 439/622; 337/230

(58) Field of Classification Search ..... 439/622, 439/621, 250, 366, 698, 830, 890, 893, 217, 439/218; 337/230, 198, 284
See application file for complete search history.

(56) References Cited

U.S. PATENT DOCUMENTS 5,215,479 A 6/1993 Araki et al.
6,443,771 B1 * 9/2002 Kondo et al. ..... 439/621
6,666,722 B1 * 12/2003 Fukumori et al. ..... 439/621
6,781,503 B1 8/2004 Kubota
2004/0155749 A1 8/2004 Fujii

FOREIGN PATENT DOCUMENTS

JP A 2002-124175 4/2002
JP A 2002-313212 10/2002

* cited by examiner

*Primary Examiner*—Tho D. Ta
*Assistant Examiner*—Felix O. Figueroa
(74) *Attorney, Agent, or Firm*—Oliff & Berridge, PLC

(57) ABSTRACT

A fuse-receiving housing is capable to receive selectively one of a mini-fuse and a low height fuse and is provided in an electrical junction box. The housing has a common insertion-limiting part on the inner walls of its cavity. The inner walls are opposed to narrow opposite end surfaces of the received fuses. The common insertion-limiting part is a pair of engagement ribs that has at sloping top surfaces at the upper part thereof that inclines downward and approaches to each other to provide a tapering gap. The engagement ribs locate the low height fuse in the housing when lower surfaces of stepped portions of the fuse body engage the top surfaces. Likewise, the engagement ribs locate the mini-fuse in the housing when lower end edges of a fuse body of the mini-fuse engage the top surfaces.

8 Claims, 4 Drawing Sheets

FUSE-RECEIVING STRUCTURE AND ELECTRICAL JUNCTION BOX USING FUSE-RECEIVING STRUCTURE

CROSS-REFERENCE TO RELATED APPLICATION

The invention claims priority to Japanese Patent Application No. JP 2004-170314 filed on Jun. 8, 2004. The disclosure of the prior application is incorporated herein by reference in its entirety.

BACKGROUND

This invention relates to a fuse-receiving structure and to an electrical junction box having such a fuse-receiving structure, such as a junction box, a fuse box or the like that is mounted on a motor vehicle, and more particularly relates to a fuse-receiving structure useful in an electrical junction box that can contain fuses having different sizes in height.

Many fuses are accommodated in an electrical junction box to be mounted on a motor vehicle. Each fuse typically comprises a fuse element including an input terminal, an output terminal spaced from the input terminal in the longitudinal direction of the fuse, a fusible portion disposed between the input and output terminals, and an insulation resin fuse body embedding the fuse element therein. The input and output terminals project from lower surfaces of the fuse body at the longitudinal ends thereof.

Recently, a so-called low height fuse has been provided in order to reduce the size of fuses. The low height fuse has input and output terminals that do not project from the lower-most surface of the fuse body but project from opposite ends of a central portion of the T-shaped fuse body, so that the terminals are disposed in parallel and hardly extend below the fuse body, thereby reducing the vertical size of the fuse.

Japanese Laid-Open Patent Application No. JP-A-2002-313212 discloses a fuse-receiving housing that accommodates such a low height fuse. This structure is illustrated in FIG. 4. A fuse-receiving housing 1 includes press contact tabs 4 that project into a cavity 3 enclosed by peripheral side walls 2. Each of the press contact tabs 4 is formed by bending a bus bar of an internal circuit. A low height fuse 8 includes a fuse body 5, an input terminal 6 and an output terminal 7 that extend at the opposite ends of the central portion of fuse body 5. The low height fuse 8 is inserted into the cavity 3 so that the press contact tabs 4, which have narrow-mouthed slots, are pressed onto the input and output terminals 6 and 7.

However, although the fuse-receiving housing disclosed in JP-A-2002-313212 can accommodate the low height fuse, it cannot accommodate a standard fuse (known as mini-fuse) that has been generally used and has input and output terminals projecting from a lower surface of a fuse body. That is, a fuse engagement section provided on a fuse-receiving housing engages a fuse body to locate and hold a fuse. However, because the input and output terminals are attached to different positions on the fuse bodies of the low height fuse and the mini-fuse, it is impossible to use the same fuse-receiving housing for both fuses.

The low height fuse has not been used widely but is expected to be widely used in the future in accordance with the desired application of fuses. It will take a very high cost to prepare electrical junction boxes including different fuse-receiving housings for the low height fuse and the mini-fuse. Accordingly, it has been required to provide a separate fuse-receiving housing that can accommodate the low height fuse and mini-fuse selectively.

Japanese Laid-Open Patent Application No. JP-A-2002-124175 discloses a fuse-receiving structure compatible with both a mini-fuse and a low-height fuse. A cavity contains tabs to contact the fuse terminals. To limit the depth of insertion of the low height fuse, the structure has a stop member projecting upwardly between the tabs, to engage the lower end of the central portion of the low height fuse.

SUMMARY

In view of the above problem, an object is to provide a fuse-receiving housing that can accommodate both the low height fuse and mini-fuse selectively, in a simple and effective manner.

In order to solve the above problems, a fuse-receiving structure is adapted to receive selectively both of a first type of fuse and a second type of fuse, which has a different shape from the first type. The first and second types of fuse each have a resin fuse body having a longitudinal direction, a fusible element is embedded therein, and input and output terminals projecting downwards in a vertical direction perpendicular to a longitudinal direction from respective end portions of the fuse body. A length of the input and output terminals in the vertical direction is shorter in the first type of fuse than in the second type of fuse. The fuse the fuse-receiving structure includes a housing that selectively receives one of the first type of fuse and the second type of fuse and includes a cavity defined by end walls that face each other, the cavity receiving at least a part of a fuse body of the received fuse, a pair of engagement ribs provided on the end walls, the engagement ribs projecting towards an opposite end wall, a sloped top surface positioned on each engagement rib, the sloped top surface sloping downwardly towards a sloped top surface of the other engagement rib to define a tapering gap therebetween and being positioned relative to each other to engage and support a lower surface portion of the received fuse thereby defining and limiting an insertion depth of the received fuse, and input and output terminal members that are positioned in the housing and contact respectively the input and output terminals of the received fuse.

There is thus achieved a structure that is compatible with both the low height fuse and the mini-fuse and can receive one of these fuses selectively as desired.

That is, because taper angles of the sloped surfaces of the engagement ribs are provided so that the sloped top surfaces engage the lower surface of a low end portions of the fuse body of the first fuse (low height fuse) or the second fuse (mini-fuse), the structure of the embodiment can locate and hold both of the first and second fuses in a simple and convenient manner.

Because the first and second fuses are located and held at the opposite ends of the fuse bodies by the tapered surfaces of the engagement ribs, the fuses can be stably secured in the fuse-receiving section. Also, because the surfaces from which the input and output terminals extend downwardly are located and held at the same position, it is possible to hold the input and output terminals at the same position in height and to engage the input and output terminals with the tabs projecting upwardly into the fuse containing section at the same position.

As described above, by providing the engagement ribs having the tapered top surfaces on the fuse containing section, the same fuse containing section can locate and hold the first fuse (low height fuse) having a small size in height and a second fuse (mini-fuse) having a large size in height. Accordingly, it is not necessary to separately provide a special fuse containing section for the low height fuse and a special fuse containing section for the mini-fuse. The gradient of the tapered top surface on the engagement rib is decided from a shape of the fuse body and a shape of the terminal so that the fuse can be fitted at a given position in height in the fuse containing section.

As described above, because the common locating section can locate the first fuse and the second fuse in the cavity so that the input and output terminals of the first fuse and the second fuse can be connected at the given position to the tabs projecting into the cavity, it is possible to selectively accommodate the first fuse and second fuse having different sizes in height in only a single fuse containing housing. Accordingly, it is not necessary to provide special fuse containing sections for the first fuse and the second fuse. Furthermore, because the first and second fuses are located by the same locating section, and it is not necessary to provide engagement ribs in connection with shapes of the respective fuses, a configuration of cavity can be simplified.

The directional terms, such as "vertical," "downward," "transverse." are used for convenience and clarity. In actual practice, the fuse-receiving structure according to the embodiment may be used in any suitable orientation.

BRIEF DESCRIPTION OF THE DRAWINGS

An exemplary embodiment of the application is described by way of non-limitative example with reference to the accompanying drawings, wherein.

DETAILED DESCRIPTION OF EMBODIMENTS

Figure 1A:
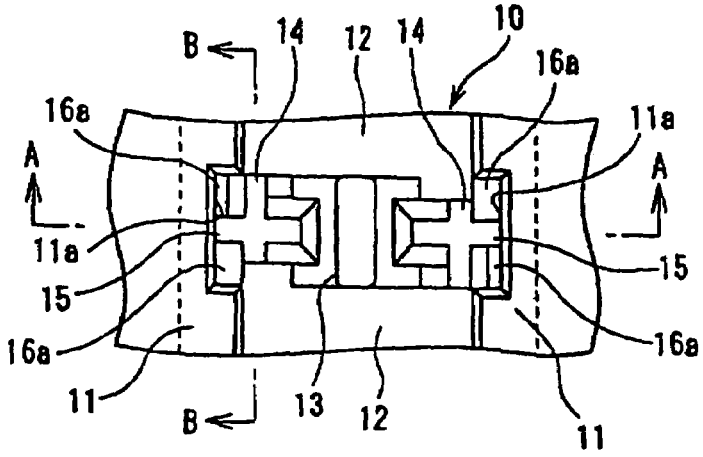
FIG. 1A is a plan view of a fuse-receiving housing according to an embodiment.

FIGS. 1A to 3 show a fuse-receiving housing 10 according to an embodiment. The fuse-receiving housing 10 is adapted to receive both of a first fuse (low height fuse) 20 and a second fuse (mini-fuse) 30 selectively without modification of the housing 10 or of the fuses 20 or 30, which are of standard shapes. The first and second fuses 20 and 30 have different heights in the vertical direction (the top-to-bottom direction in the drawings).

Figure 1B:
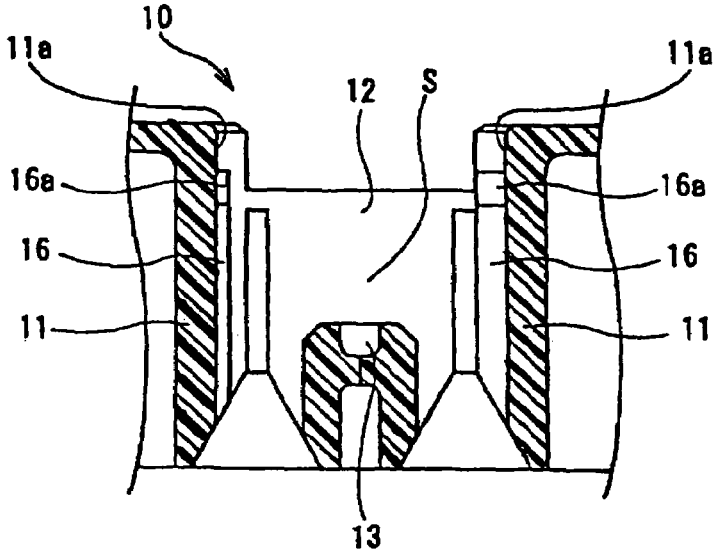
FIG. 1B is a longitudinal sectional view of the fuse-receiving housing along line A—A in FIG. 1A.
Figure 1C:
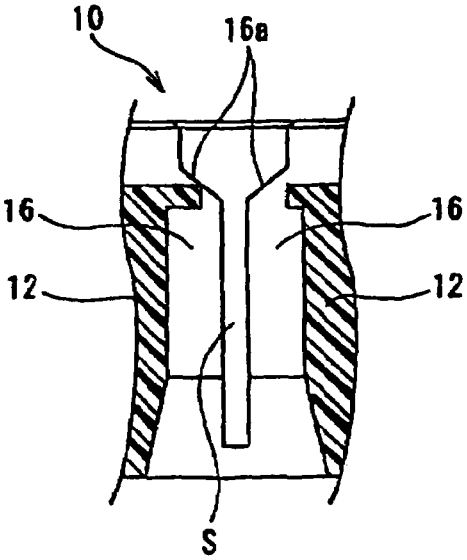
FIG. 1C is a cross-sectional view of the fuse-receiving housing along line B—B in FIG. 1A.

As shown in FIGS. 1A to 1C, the housing 10 has a cavity S defined in a longitudinal direction by a pair of first side walls 11 and by a pair of second side walls 12. The structure of the housing 10 illustrated is a portion of an electrical junction box (not shown), which may be a conventional type. The electrical junction box may have a plurality of the housing 10 for receiving many fuses, and each of these housings 10 may be compatible with both types of fuse 20, 30. The structure of the housing 10 shown in the drawings is, apart from the metal tabs to be described, formed in one-piece of suitable molded plastics resin material. The first side walls 11 are spaced apart at a given distance from each other on an upper wall of a casing of the electrical junction box and are opposed to each other. The second side walls 12 may serve to connect the first side walls 11 to each other.

A bottom wall 13 is provided on a central bottom part in the cavity S enclosed by the first and second side walls 11, 12. Wide tab holes 14 are defined between the first side walls 11 and the bottom walls 13. Press contact tabs 17 pass through the tab holes 14 (see FIGS. 2A and 2B). Each tab 17 is formed by bending an end of a bus bar (not shown) contained in the casing of the electrical junction box and by providing a press contact slot in the distal end of the tab 17. As shown in FIGS. 2B and 3, the slots of the tabs 17 have narrow mouths, to engage with pressure on the fuse terminals. Wide terminal holes 15 are provided in the housing 10 in the right and left direction or a direction perpendicular to the tab holes 14. Distal ends of input and output terminals 21, 22, 31, 32 of the first and second fuses 20, 30 pass through the terminal holes 15 to engage in the slots of the tabs 17 by pressure contact, to establish the electrical connections.

Two pairs of engagement ribs 16 are provided on inner wall faces 11*a* in the cavity S. The inner wall faces 1 a are opposed to narrow opposite end walls 23*d*, 33*c* of the resin bodies of the first and second fuses 20, 30. Each pair of engagement ribs 16 is disposed on the opposite sides of each terminal hole 15 in the transverse direction. The ribs 16 extend downward in the vertical direction and are provided at their tops with tapered surfaces 16*a* inclining gently downward and approaching to each other to define a downwardly tapering gap between them. These engagement ribs 16 constitute a common locating section that serves to support both the first and second fuses 20, 30 (whichever is present in the housing 10) at given heights in the housing 10.

Figure 2A:
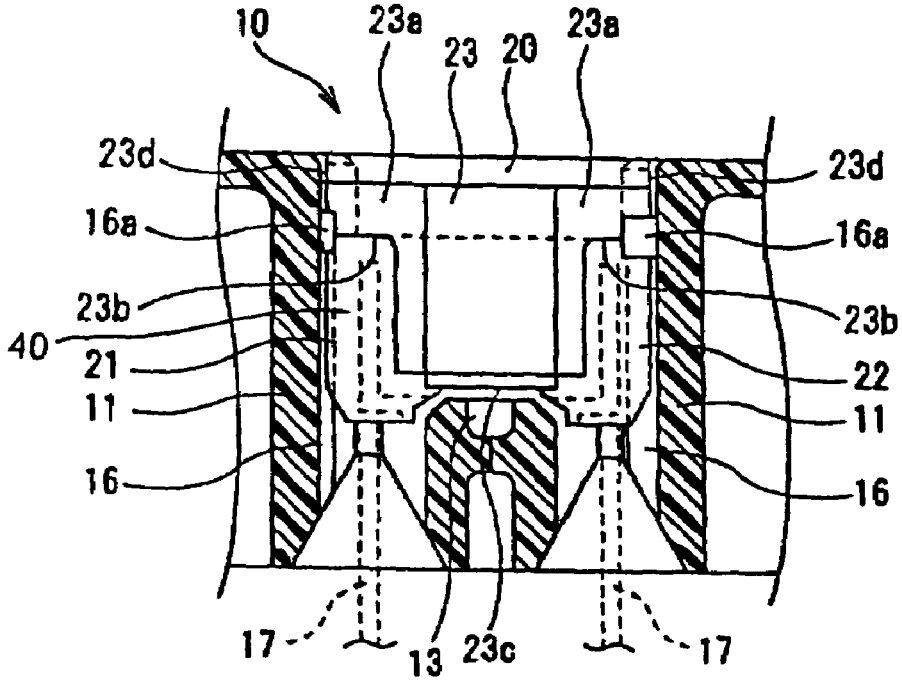
FIG. 2A is a longitudinal sectional view similar to FIG. 1B, showing a first fuse fitted in the fuse-receiving housing.
Figure 2B:
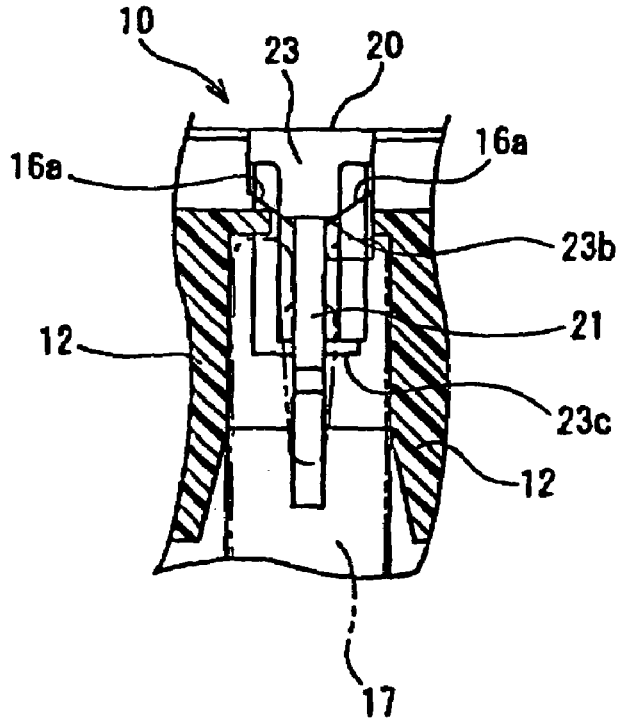
FIG. 2B is a cross-sectional view similar to FIG. 1C, also showing the first fuse fitted in the fuse containing housing.
Figure 3:
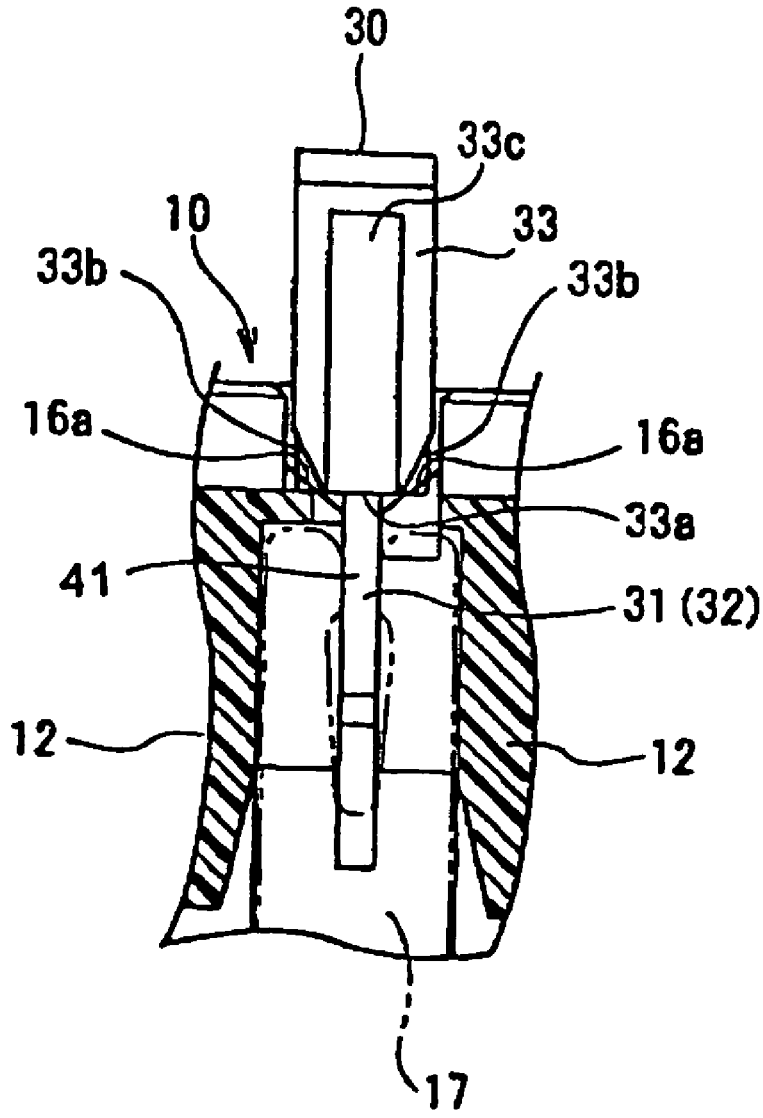
FIG. 3 is a cross-sectional view similar to FIG. 1C, showing a second fuse fitted in the fuse-receiving housing.
Figure 4:
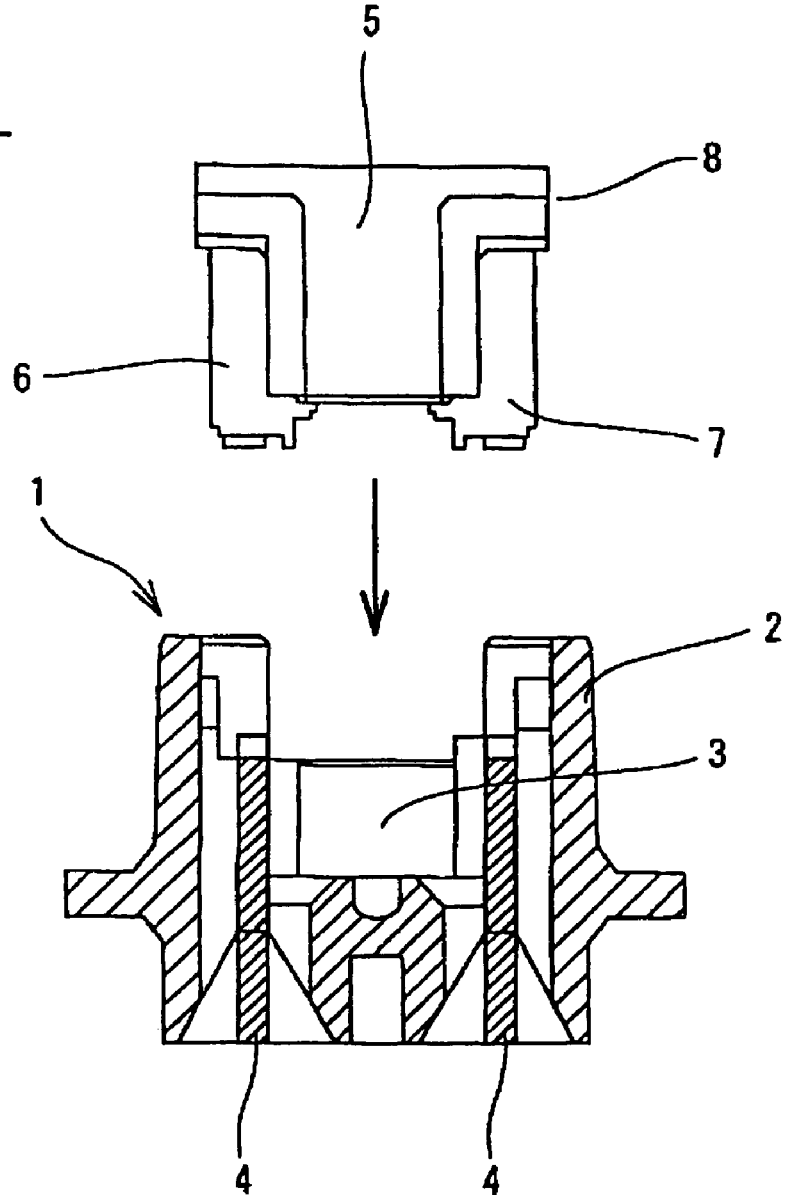
FIG. 4 RELATED ART
FIG. 4 is a longitudinal sectional view similar to FIG. 1B, illustrating an operation of fitting a fuse into a known fuse-receiving housing, described above.

The first fuse 20, which is a low height fuse having a relatively small size in a vertical direction, as shown in FIG. 2A, includes a fuse element 40 including an input terminal 21 and an output terminal 22 spaced longitudinally, a fusible portion (not shown) coupling the input and output terminals 21, 22 to each other, and a resin fuse body 23 embedding the fuse element 40 therein. The fuse body 23 has stepped portions 23*a*, of smaller transverse width than the top portion and central portion of the fuse body 23, extending horizontally from the opposite ends of the central portion of the fuse body 23. The input and output terminals 21, 22 extend through the stepped portions 23*a*. The lower surfaces 23*b* of the stepped portions 23*a* may not be tapered surfaces but may be flat horizontal surfaces, as shown in FIG. 2B. The distal horizontal surfaces, as shown in FIG. 2B. The distal ends of the input and output terminals 21, 22 extend slightly over a bottom surface 23*c* of the fuse body 23. 21, 22 extend slightly over a bottom surface 23*c* of the fuse body 23.

The second fuse 30, which is a mini-fuse having a relatively large size in a vertical direction, as shown in FIG. 3, includes a fuse element 41 including an input terminal 31, an output terminal 32, a fusible portion (not shown) coupling the input and output terminals 31, 32 to each other, and a resin fuse body 33 embedding the fuse element 41 therein. The input and output terminals 31, 32 extend downwardly from a lower end surface 33*a* of the fuse body 33. The fuse body 33 is provided at each of the four corners of the lower end surface 33*a* with a tapered surface 33*b* inclining in the transverse direction. The gradient (slope angle) of the tapered surface 33*b* may be greater than that of the tapered surface 16*a* on the top side of the engagement rib 16 of the housing 10.

The distance between the input and output terminals 31, 32 of the second fuse 30 may be the same as that between the input and output terminals 21, 22 of the first fuse 20.

When the first fuse 20 is inserted into the housing 10, as shown in FIG. 2B, the opposite side edges of the lower surfaces 23*b* of the stepped portions 23*a* of the first fuse 20 contact the tapered surfaces 16*a* on the upper ends of the engagement ribs 16 provided on the housing 10, so that the first fuse 20 can not advance further into the housing 10. Consequently, the first fuse 20 is held at the desired regular position in the housing 10. At this time, the input and output terminals 21, 22 of the first fuse 20 pass through the tab holes 14 in the fuse containing housing 10 and forcedly engage the press contact tabs 17 projecting into the housing 10. The input and output terminals 21, 22 of the first fuse 20 may be connected with an internal circuit in the electrical junction box. Also, because the first fuse 20 is supported and located by the tapered surfaces 16*a* of the ribs 16, the bottom surface of the first fuse 20 may not contact the upper end surface on the bottom wall 13 in the housing 10.

On the other hand, when the second fuse 30 is inserted into the housing 10, as shown in FIG. 3, the lower edges of the tapered surfaces 33*b* provided on the bottom side of the second fuse 30 contact the tapered surfaces 16*a* on the upper ends of the engagement ribs 16 provided on the housing 10, so that the second fuse 30 may not advance further in the housing 10. Consequently, the second fuse 30 is located at the desired regular position in the housing 10. At this time, the input and output terminals 31, 32 of the second fuse 30 forcedly engage the press contact tabs 17 projecting into the housing 10. The input and output terminals 31, 32 of the second fuse 30 may be connected with the internal circuit in the electrical junction box. Also, because the gradient of the tapered surfaces 33*b* may be greater than that of the tapered surfaces 16*a* of the engagement rib 16, only the lower end edges of the tapered surfaces 33*b* of the second fuse 30 contact the tapered surfaces 16*a* of the engagement ribs 16. Thus, the tapered surfaces 16*a*, 33*b* are not brought into surface contact with each other.

In the above structure, even if the first fuse 20 or the second fuse 30 is inserted into the housing 10, the fuse body 23 of the first fuse or the fuse body 33 of the second fuse 30 contacts the tapered surfaces 16*a* on the distal ends of the ribs 16 in the housing 10, and the first fuse 20 or the second fuse 30 is located at the predetermined position. Then, the input and output terminals 21, 22 or 31, 32 may be connected to the internal circuit. Accordingly, it is possible to attach the first fuse 20 or the second fuse 30 to the fuse-receiving housing 10 selectively. Moreover, it is not necessary to prepare special fuse-receiving housings 10 for the first and second fuses 20, 30.

While the invention has been described in conjunction with the exemplary embodiments described above, many modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A fuse-receiving structure adapted to receive selectively both of a first type of fuse and a second type of fuse having a different shape from the first type, the first and second types of fuse each having a resin fuse body having a longitudinal direction, a fusible element embedded therein, and input and output terminals projecting downwards in a vertical direction perpendicular to a longitudinal direction the fuse body, a length of the input and output terminals in the vertical direction being shorter in the first type of fuse than in the second type of fuse of the fuse, the fuse-receiving structure comprising:

a housing that selectively receives one of the first type of fuse and the second type of fuse, the housing including a cavity defined by end walls that face each other, the cavity receiving at least a part of a fuse body of the received fuse;

a pair of engagement ribs provided on the end walls, the engagement ribs projecting towards an opposite end wall;

a sloped top surface positioned on each engagement rib, the sloped top surface sloping downwardly towards a sloped top surface of the other engagement rib to define a tapering gap therebetween and being positioned relative to each other to engage and support a lower surface portion of the received fuse thereby defining and limiting an insertion depth of the received fuse, the sloped top surface constituting a common locating section to support either of the first and second type of fuse; and input and output terminal members that are positioned in the housing and contact respectively the input and output terminals of the received fuse.

2. A fuse-receiving structure according to claim 1, wherein when a fuse of the first type of fuse is received therein, the insertion position thereof is determined by contact of the fuse body thereof with the sloped top surfaces of the pairs of ribs.

3. A fuse-receiving structure according to claim 2, wherein the fuse of the first type of fuse has stepped portions of the fuse body at longitudinal ends, and the insertion position of the fuse is determined by contact of lower surfaces of the stepped portions with the sloped top surface of the pairs of ribs.

4. A fuse-receiving structure according to claim 1, wherein when a fuse of the second type of fuse is received therein, the insertion position thereof is determined by contact of the fuse body thereof with the sloped top surfaces of the pairs of ribs.

5. A fuse-receiving structure according to claim 4, wherein the insertion position of the fuse of the second type of fuse is determined by contact of lower edges of the fuse body thereof with the sloped top surfaces of the pairs of ribs.

6. An electrical junction box having at least one fuse-receiving structure according to claim 1.

7. An electrical junction box having at least one fuse-receiving structure according to claim 2.

8. An electrical junction box having at least one fuse-receiving structure according to claim 4.

* * * * *